United States Patent [19]

Ten Eyck et al.

[11] Patent Number: 4,779,754

[45] Date of Patent: Oct. 25, 1988

[54] DRAINING LID

[75] Inventors: Robert J. Ten Eyck, Saint Paul; Gerald L. Burns, Eagan; Melvin A. Franzwa, Inver Grove Hts., all of Minn.

[73] Assignee: Ecolab Inc., St. Paul, Minn.

[21] Appl. No.: 73,520

[22] Filed: Jul. 15, 1987

[51] Int. Cl.[4] ..... B65D 8/00

[52] U.S. Cl. ..... 220/66; 220/5 R; 220/74

[58] Field of Search ..... 220/66, 74, 5 R, 254, 220/465

[56] References Cited

U.S. PATENT DOCUMENTS

| | | | |
|---|---|---|---|
| 4,628 | 11/1871 | Chace | 99/610 |
| 335,520 | 2/1886 | Hess et al. | 222/108 |
| 773,879 | 11/1904 | Major | 222/130 |
| 971,290 | 9/1910 | Mansor | 62/298 |
| 1,413,907 | 4/1922 | Gerstenberger | 220/68 |
| 1,746,332 | 2/1930 | Barroll | 222/571 |
| 1,765,062 | 6/1930 | Draper | 220/254 |
| 2,049,977 | 8/1936 | Ross et al. | 220/66 |
| 2,449,445 | 9/1948 | Bodan | 4/252 |
| 3,143,238 | 8/1964 | Bulgrin | 220/5 R |
| 3,393,821 | 7/1968 | Verlinden | 220/5 R |
| 3,927,790 | 12/1975 | Chase et al. | 220/5 R X |
| 3,934,747 | 1/1976 | Needt | 220/5 R |
| 3,972,450 | 8/1976 | Walters | 222/91 |
| 4,228,911 | 10/1980 | Hammes | 220/74 X |
| 4,385,709 | 5/1983 | Ames | 220/5 R X |
| 4,531,657 | 7/1985 | Saito et al. | 222/108 |

*Primary Examiner*—Steven M. Pollard

*Attorney, Agent, or Firm*—Merchant, Gould, Smith, Edell, Welter & Schmidt

[57] ABSTRACT

A novel lid for use on a container which is designed such that water or other liquids which gather on the lid drains out over the inner and outer peripheral rims of the lid rather than into the opening of the lid, thus avoiding contamination of the container contents. The lid comprises an outer peripheral rim, an inner peripheral rim, and a central lid area. The outer peripheral rim typically contains a plurality of notches. The inner peripheral rim, which lies within the outer peripheral rim, also typically contains a plurality of notches. The central lid area, which lies within the inner peripheral rim and outer peripheral rim, contains an opening. The opening is surrounded by an opening rim.

22 Claims, 5 Drawing Sheets

DRAINING LID

FIELD OF THE INVENTION

The invention relates generally to a lid having a central lid area, an inner peripheral rim and an outer peripheral rim. The central lid area is in fluid communication with the inner peripheral rim. The inner peripheral rim is also in fluid communication with the outer peripheral rim. The lid is intended for use on a container. The central lid area has an opening which allows access to the container contents without removing the lid from the container. The lid is designed such that water, or other liquid material, which may gather on the top of the lid, drains out over the rims of the lid rather than into the opening of the lid thus avoiding contamination of the container contents.

BACKGROUND OF THE INVENTION

Lids have commonly been used over the years to seal the contents of containers. Oftentimes one desires to remove the contents from a container without having to remove the lid itself. To solve this problem, lids having an opening have been manufactured. The contents of a container having such a lid can be removed by inserting a tube, pipe, or other instrument through the opening of the lid into the container. The tube, pipe, or other instrument can thus be used to draw the contents of the container out through the opening in the lid without removing the lid itself. The container contents can also be removed by tilting the container so that the contents pour out through the opening in the lid. A spout is often times attached to the rim surrounding the opening for this purpose.

The lids of the prior art typically comprise a central lid area having an opening, an outer peripheral rim and an inner peripheral rim. The opening is typically surrounded by an opening rim. The opening rim may be threaded to allow the user to screw a cap onto the opening rim to cover the opening. The opening and the opening rim are typically situated in a recessed portion of the central lid area. The recessed portion comprises a sidewall portion and a bottom portion. The opening and the opening rim are typically situated in the bottom portion of the recessed portion.

The top portion of the opening rim extends such that it is substantially level with the rest of the central lid area. The inner peripheral rim extends about 1 centimeter above the central lid area. The outer peripheral rim extends about 1.5 centimeters above the inner peripheral rim or about .5 centimeters above the central lid area.

Between the inner and outer peripheral rims is typically a groove. The underside of the groove fits inside the container upon which the lid is situated thus serving to secure the lid to the container.

Oftentimes such lids are used on containers in areas where water or other liquids can collect on the top of the container lid. Water or other liquids oftentimes gathers on top of such a container lid and runs down into the opening in the central lid area, thus contaminating the contents of the container.

The present invention solves this problem by providing for a lid wherein water or other liquids which gather on top of the lid will drain down over the inner and outer peripheral rims of the lid rather than into the opening of the lid.

BRIEF DESCRIPTION OF THE INVENTION

We have found a novel lid that comprises an outer peripheral rim, an inner peripheral rim, and a central lid area. The central lid area is cooperatively connected to the inner peripheral rim. The inner peripheral rim is cooperatively connected to the outer peripheral rim. The outer peripheral rim contains a plurality of notches. The inner peripheral rim, which lies within the outer peripheral rim, also contains a plurality of notches. The notches in the inner peripheral rim and outer peripheral rim enable the central lid area to exist in fluid communication with the inner and outer rims respectively. The central lid area, which lies within the inner peripheral rim and outer peripheral rim, contains an opening. The opening is surrounded by an opening rim. The lid of the present invention allows the drainage of water or other liquids which has collected on the surface of the lid out over the inner peripheral rim and outer peripheral rim rather than into the opening of the container.

DETAILED DESCRIPTION OF THE INVENTION

Figure 1:
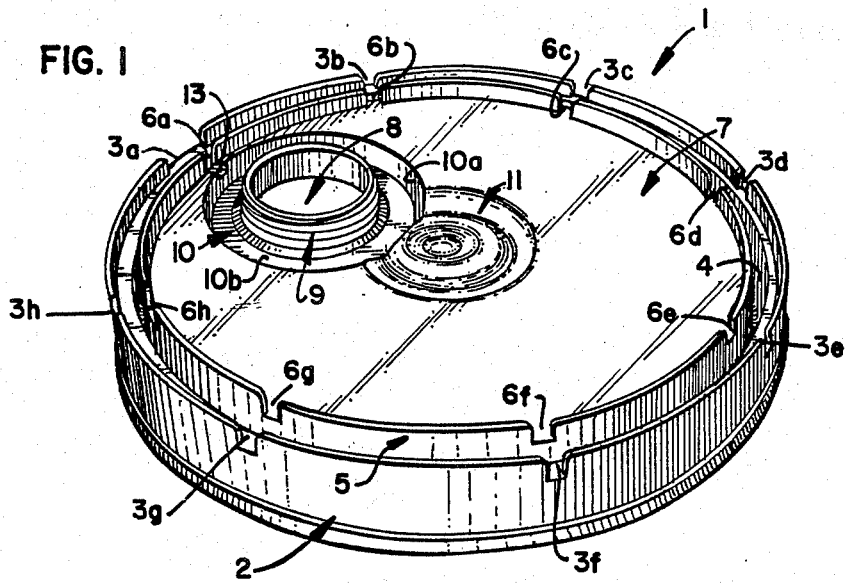
FIG. 1 is an overall perspective view of the draining lid of this invention.

Referring to the drawing, wherein like numerals represent like parts throughout the several views:

There is generally a designated lid at 1 for a container having a central lid area 7, an outer peripheral rim 2 having a plurality of notches 3(*a–h*) formed therein, and an inner peripheral rim 5 having a plurality of notches 6(*a–h*) formed therein. The central lid area 7 is cooperatively connected to the inner peripheral rim 5. The inner peripheral rim 5 is cooperatively connected to the outer peripheral rim 5. The notches 6(*a–h*) in the inner peripheral rim 5 and the notches 3(*a–h*) in the outer peripheral rim 2 enable the central lid area 7 to exist in fluid communication with the inner peripheral rim 5 and outer peripheral rim 2 respectively.

The central lid area 7 has an opening 8 surrounded by an opening rim 9 which allows access to the container 14 contents. The opening 8 and opening rim 9 can lie in a recessed portion 10 of the central lid area 7. The recessed portion 10 comprises a bottom portion 10*b* cooperatively connected to a sidewall portion 10*a*. The opening 8 and the opening rim 9 are typically situated in the bottom portion 10*b* of the recessed portion 10. The opening rim 9 is typically cooperatively connected to the recessed portion 10, typically the bottom portion 10*b* of the recessed portion 10. The recessed portion 10 of the central lid area 7 can lie adjacent to a notch 6(*a–h*) in the inner peripheral rim 5 or can be connected to a notch 6(*a–h*) in the inner peripheral rim 5 by a channel means 13 which is formed in the central lid area 7. The lid 1 is designed such that water or other liquids which gathers on the lid 1 does not drain into the opening 8 contained in the central lid area 7, but rather down through the notches 6(*a–h*) contained in the inner peripheral rim 5 and the notches 3(*a–h*) contained in the outer peripheral rim 2 of the lid 1. Water or other liquids which gather in the recessed portion 10 of the central lid area 7 is drained by the channel means 13 which leads into a notch 6*a* in the inner peripheral rim 5.

Alternatively, the opening rim 9 can be cooperatively connected to the top of the central lid area 7 rather than to a recessed portion 10 of the central lid area 7. In such an embodiment the central lid area 7 would not contain a recessed portion 10. Preferably the opening rim 9 is situated in a recessed portion 10 to maximize the height of the opening rim 9 and to make it easier to fasten a cap on the opening rim 9.

The lid 1 of the present invention can be used on containers 14 of various sizes and shapes. The shape of the lid 1 is dictated by the shape of the container 14 for which the lid 1 is intended. The shapes in which the lid 1 of the present invention can be made include, but are not limited to, the following:: circular, oval, square, and rectangular.

The area of the lid 1 of the present invention is dependent upon the size of the container 14 for which the lid 1 is intended.

The lid 1 of the present invention can be made from any suitable material including but not limited to steel and plastic.

Plastics from which the lid 1 of the present invention can be made include, but are not limited to, the following: polypropylene, polystyrene, and polyethylene. The preferred material for the lid 1 composition depends in part upon the intended use of the container 14 on which the lid 1 is to be used. If the container 14 is intended to store liquid detergents, a polyethylene resin is the preferred material.

Preferred polyethylene resins for use in the lid 1 of the present invention comprise high-density polyethylene resins having a density of about 0.945 to 0.960 grams/cubic centimeter. It is possible that medium density polyethylene resins could also be used. Typically the higher the density of the polyethylene resin, the higher its processability. The preferred density of the polyethylene resin, however, is a function of the design of the mold and the machine used in forming the lid 1 of the present invention.

Another factor to consider in selecting the density of the polyethylene resin to be used in the lid 1 of the present invention is the contents of the container 14 upon which the lid 1 is to be situated. The contents of the container 14 may comprise a detergent containing a surfactant. Detergents containing surfactants are stress crackers to polyethylene. The lower the density of the polyethylene resin, the higher its stress crack resistance. Conversely, the higher the density of the polyethylene resin, the lower its stress crack resistance.

Melt index is another factor to consider when selecting the polyethylene resins useful in the lid 1 of the present invention. Preferably, the melt index of the polyethylene resins useful in the lid 1 of the present invention can range from about 3 to 8 grams/ten minutes. The lower the melt index of the polyethylene resin, the higher its stress crack resistance, but the lower its processability. Conversely, the higher the melt index of the polyethylene resin, the lower its stress crack resistance but the higher its processability.

Melt index is a measurement of the molecular weight distribution of a resin. The measurement is performed according to the standards set forth by the American Society of Testing and Materials. Specifically, melt index is the number of grams of a polymer that can be forced through a 0.0825 inch orifice in 10 minutes at 190° C. by a pressure of 2,160 grams.

The lid 1 of the present invention comprises an outer peripheral rim 2, an inner peripheral rim 5 and a central lid area 7.

THE OUTER PERIPHERAL RIM

The outer peripheral rim 2 serves several purposes. First the outer peripheral rim 2 provides impact resistance strength to the lid 1. The outer peripheral rim 2 helps insure that if a container 14 having the lid 1 of the present invention is dropped that the lid 1 will stay on.

Second the outer peripheral rim 2 helps insure the stability of containers 14 having the lid 1 of the present invention upon adjacent stacking. Containers 14 having the lid 1 of the present invention are oftentimes stacked vertically and adjacent to one another.

The outer peripheral rim 2 comprises an upper portion and a lower portion. The underside of the lower portion of the outer peripheral rim 2 fits upon the edge of the container 14 for which the lid 1 of the present invention is intended. The underside of the lower portion typically contains a rubber ring 12 which helps seal the container 14 upon which the lid 1 is placed.

The lower portion of the outer peripheral rim 2 comprises a ledge 2*a*, an inner vertical side 2*b*, and an outer vertical side 2*c*. The ledge 2*a* is cooperatively connected to the inner vertical side 2*b* and the outer vertical side 2*c*. The width of the ledge 2*a* can vary depending upon the width of the rim of the container 14 upon which the lid 1 fits. The underside of the ledge 2*a* fits directly on top of the edge of the container 14 for which the lid 1 is intended. The lid 1 of the present invention typically has an indentation 4 between the inner peripheral rim 5 and the outer peripheral rim 2. The indentation is defined by the cooperative connection of the inner vertical side 2*b* of the outer peripheral rim 2 and the outer side of the inner peripheral rim 5. The indentation 4 forms a projection on the underside of the lid 1 which serves to secure the lid on to a container 14. The projection fits inside the walls of the container 14 and thus holds the lid 1 onto the container. It is not necessary that the indentation 4 appear on the upper surface of the lid 1. However, to fill in the indentation 4 would require an expenditure of material and would result in a heavier lid 1. The lid 1 would still function, however, if the indentation 4 was filled. Filling the indentation 4 would result in the benefit that water would not collect in the indentation 4 as the water or other liquids drain through the notches 6(*a–h*) in the inner peripheral rim 5 to the notches 3(*a–h*) in the outer peripheral rim 2.

The inner vertical side 2*b* of the outer peripheral rim 2 forms one side of the indention 4 in the upper surface of the lid 1. The other side of the indentation 4 is provided by the outer surface of the inner peripheral rim 5. The outer vertical side 2*c* of the outer peripheral rim 2 forms the lower outer portion of the outer peripheral rim 2.

The upper portion of the outer peripheral rim 2 comprises a border portion 2*d*. The border portion 2*d* is cooperatively connected to the ledge 2*a* of the lower portion of the outer peripheral rim 2. The thickness of the border portion 2*d* can vary. The border portion 2*d* can be as thick as the ledge 2*a* itself. Alternatively, the border portion 2*d* can be thinner than the ledge 2*a*. Preferably, the border portion is thicker than about 1/16" to insure adequate stability of the border portion 2*d*. To conserve on materials, it is preferable that the border portion 2*d* be thinner than the ledge 2*a* itself. It is possible that the border portion 2*d* may be thicker than the ledge 2*a* to which it is cooperatively connected. However, if the border portion is thicker than the ledge 2*a* itself it could result in processing difficulties and result in a waste of material from which the lid 1 is made. It is also preferable that the border portion 2*d* of the outer peripheral rim 2 line up substantially with the outer vertical side 2*c* of the outer peripheral rim 2. This helps insure the stability of adjacently stacked containers 14.

The height of the outer peripheral rim 2 as measured from the point where the central lid 7 area adjoins the inner peripheral rim 5 to the top of the border portion 2*d* of the outer peripheral rim 2 can vary. If the outer peripheral rim 2 is too high, it results in a waste of the material from which the lid is formed.

If the outer peripheral rim 2 is too low, the lid 1 may warp somewhat after it is manufactured. In addition, if the outer peripheral rim 2 is too low it could also affect the stability of the containers 14 upon adjacent stacking.

The outer peripheral rim 2 typically contains a plurality of notches 3(*a–h*). The notches 3(*a–h*) allow for the drainage of water or other liquids through the outer peripheral rim 2. A notch 3(*a–h*) can include, but is not limited to, the following: a slit, a cut, a hole, and an opening.

A notch 3(*a–h*) can be of various shapes including, but not limited to, the following: rectangular, square, circular, and oval.

Preferably the notches 3(*a–h*) are rectangular shaped for the reason that they are typically easier to form.

The notches 3(*a–h*) in the outer peripheral rim 2 preferably should not extend below the ledge 2*a* of the outer peripheral rim 2. Most preferably the notches 3(*a–h*) extend through the border portion 2*d* of the outer peripheral rim 2 to the depth of the ledge 2*a* itself. Preferably the notches 3(*a–h*) extend all the way through the top of the border portion 2*d* of the outer peripheral rim 2 to overcome the surface tension of the water which gathers on top of the lid 1 and facilitate the flow of the water off the lid 1. This helps insure the flow of water or other liquids off the lid 1 even at times when a large amount of water or other liquids is pouring onto the lid 1.

However, it is not necessary that the notches 3(*a–h*) extend through the top of the border portion 2*d* of the outer peripheral rim 2. The lid 1 will still function even though the notches 3(*a–h*) are surrounded on all sides.

The number of notches 3(*a–h*) in the outer peripheral rim 2 can vary. The number of notches 3(*a–h*) will vary according to the size and shape of the lid 1, the size and shape of the notches 3(*a–h*) themselves, and the amount of water or other liquids which is to be drained from the lid 1. It is possible that the outer peripheral rim 2 could contain only one large notch. Preferably, however the outer peripheral rim 2, contains a plurality of smaller notches to insure adequate drainage. Too few notches 3(*a–h*) could result in inadequate drainage. Too many notches 3(*a–h*) could result in a weakening of the outer peripheral rim 2 structure.

The area of each notch 3(*a–h*) contained in the outer peripheral rim 2 can vary. If the area of a notch 3(*a–h*) is too small it could result in inadequate drainage. If the area of a notch 3(*a–h*) is to a large it could interfere with the stability of the outer peripheral rim 2 structure.

THE INNER PERIPHERAL RIM

The inner peripheral rim 5 lies within the outer peripheral rim 2. The inner peripheral rim 5 serves to center containers 14 having the lid 1 of the present invention upon vertical stacking of the containers 14 and also prevent lateral movement thereof. In vertical stacking of containers 14 having the lid 1 of the present invention, the bottom of a container 14 fits within the central lid area 7 of the lid 1 on the container 14 below. No weight from the container 14 above is exerted on the inner peripheral rim 5 or outer peripheral rim 2 of the lid 1 on the container 14 below. The bottom of such a container 14 is oftentimes concave. This is beneficial in that it prevents contact of the container 14 bottom with the opening rim 9 of the lid 1 below.

The height of the inner peripheral rim 5 as measured from the point where the inner peripheral rim 5 meets the central lid area 7 to the top of the inner peripheral rim 5 can vary.

If the inner peripheral rim 5 is too high, it results in a waste of material from which the lid 1 is made.

If the inner peripheral rim 5 is too low, a container 14 stacked upon the lid 1 could shift and slide if shaken.

The ratio of the height of the inner peripheral rim 5 to the outer peripheral rim 2 can vary, wherein the heights of the outer peripheral rim 2 and inner peripheral rim 5 are measured from the point where the central lid area 7 adjoins the inner peripheral rim 5 to the top of the outer peripheral rim 2 and to the top of the inner peripheral rim 5 respectively.

Preferably, the heights of the inner peripheral rim 5 and outer peripheral rim 2 are the same for esthetic reasons. If either rim is too high it would result in a waste of materials from which the lid 1 is made.

The number of notches 6(*a–h*) in the inner peripheral rim 5 can vary. It is possible that the inner peripheral rim 5 could contain only one large notch. Preferably, the inner peripheral rim 5 contains a plurality of notches to insure adequate drainage. The number of notches 6(*a–h*) will vary according to the size and shape of the lid, the size and shape of the notches 6(*a–h*), and the amount of water which is to be drained from the lid 1. Too few notches 6(*a–h*) in the inner peripheral rim 5 could result in inadequate drainage. Too many notches 6(*a–h*) in the inner peripheral rim 5 could result in a weakening of the inner peripheral rim 5.

The area of each notch 6(*a–h*) in the inner peripheral 5 can vary.

If the area of a notch 6(*a–h*) is too small, it could result in inadequate drainage.

If the area of a notch 6(*a–h*) is too large, it could interfere with the stability of the inner peripheral rim 5 structure.

A notch 6(*a–h*) in the inner peripheral rim 5 can include, but is not limited to, the following: a slit, a cut, a hole, and an opening.

A notch 6(*a–h*) in the inner peripheral rim 5 can be of various shapes including, but not limited to, the following:. rectangular, square, circular, and oval.

Preferably the notches 6(*a–h*) in the inner peripheral rim 5 are rectangular shaped for the reason that they are easier to form.

Preferably the notches 6(*a–h*) extend all the way through the top portion of the inner peripheral rim 5 in order to overcome the surface tension of the water which gathers on top of the lid 1 and facilitate the flow of the water off the lid 1. This helps insure the flow of water off the lid 1 even at times when a large amount of water is pouring onto the lid 1.

The notches 6(*a–h*) in the inner peripheral rim 5 do not have to be all of the same size. Preferably the notch 6*a* closest to the opening 8 in the central lid area 7 is smaller than the other notches 6(*b–h*) in order to facilitate the drainage of water out through the notches 6(*b–h*) that are not directly next to the opening 8 and the opening rim 9 so that there is less chance of water entering the opening 8.

Preferably, all the notches 6(*a–h*) extend to the same depth in order to achieve even drainage of water or other liquids from the lid 1. Preferably, all the notches 6(*a–h*) extend down to the surface of the central lid area 7 to insure adequate drainage.

The depth of the notches 3(*a–h*) in the outer peripheral rim 2 can vary. The notches 3(*a–h*) in the outer peripheral rim 2 must extend down at least to the depth of the notches 6(*a–h*) in the inner peripheral rim 5 in order for the lid to function. The notches 3(*a–h*) in the outer peripheral rim 2 preferably extend to a depth greater than the depth of the notches 6(*a–h*) in the inner peripheral rim 5 in order to facilitate the flow of water or other liquids off the lid 1. The bottom portion of the notches 6(*a–h*) in the inner peripheral rim 5 must be at a height lower than the top of the opening rim 9 in order for the lid 1 to function. The notches 6(*a–h*) in the inner peripheral rim 5 preferably extend down to the level of the adjoining central lid area 7 surface.

The notches 6(*a–h*) in the inner peripheral rim 5 do not have to line up with the notches 3(*a–h*) in the outer peripheral rim 2. Preferably, however, the notches 6(*a–h*) in the inner peripheral rim 5 line up substantially with the notches 3(*a–h*) in the outer peripheral rim 2 in order to facilitate the flow of the water or other liquids off the lid 1. If the notches 6(*a–h*) in the inner peripheral rim 5 were not lined up with the notches 3(*a–h*) in the outer peripheral rim the lid would still function but the water or other liquids would split causing turbulence and back pressure which would defeat the purpose of the lid 1 somewhat.

The notches in the outer peripheral rim 2 do not have to be all of the same size. Preferably, all the notches are the same size with the exception of notch 3*a* which is typically larger than the other notches in order that to insure the flow of water or other liquids off the lid away from the opening 8 as quickly as possible.

The ratio of the number of notches 3(*a–h*) in the outer peripheral rim 2 to the number of notches 6(*a–h*) in the inner peripheral rim 5 can range from about 1:1 to greater than about 1:1, preferably about 1:1, assuming a substantially equal total area of notches 3(*a–h*) and 6(*a–h*).

If the ratio of the number of notches 3(*a–h*) in the outer peripheral rim 2 to the number of notches 6(*a–h*) in the inner peripheral rim 5 is less than about 1:1 assuming a substantially equal total area of notches 3(*a–h*) and 6(*a–h*) then water or other liquids which has drained through the notches 6(*a–h*) in the inner peripheral rim 5 would not drain through the notches 3(*a–h*) in the outer peripheral rim 2 quickly enough which would result in a build up of water or other liquids in the central lid area 7 which could enter into the opening 8.

If the ratio of the number of notches 3(*a–h*) in the outer peripheral rim 2 to the number of notches 6(*a–h*) in the inner peripheral rim 5 is greater than about 1:1 the lid 1 would still function but the additional number of notches 3(*a–h*) in the outer peripheral rim 2 would serve no purpose.

In addition, too many notches in the outer peripheral rim 2 could result in a weakening of the outer peripheral rim 2 structure.

The ratio of the total area of the notches 3(*a–h*) in the outer peripheral rim 2 to the total area of the notches 6(*a–h*) in the inner peripheral rim 5 can range from about 1:1 to greater than above 1:1, preferably about 1:1.

If the ratio of the total area of the notches 3(*a–h*) in the outer peripheral rim 2 to the total area of the notches 6(*a–h*) in the inner peripheral rim 5 is less than about 1:1 then water or other liquids which has drained through the notches 6(*a–h*) in the inner peripheral rim 5 would not drain through the notches 3(*a–h*) in the outer peripheral rim 2 quickly enough which could result in the build up of water or other liquids in the central lid area 7 which could enter into the opening 8.

If the ratio of the total area of the notches 3(*a–h*) in the outer peripheral rim 2 to the number of notches 6(*a–h*) in the inner peripheral rim 5 is greater than about 1:1, the lid 1 would still function but the additional area of notches 3(*a–h*) in the outer peripheral rim 2 would serve no purpose.

The distance between the inner peripheral rim 5 and the border portion 2*d* of the outer peripheral rim 2 can vary. The distance between the inner peripheral rim 5 and the outer vertical side 2*c* of the outer peripheral rim 2 can also vary.

THE CENTRAL LID AREA

The lid 1 of the present invention also comprises a central lid area 7. The central lid area 7 is surrounded by the outer peripheral rim 2 and the inner peripheral rim 5.

The central lid area 7 can be substantially flat or it can be domed. If the central lid area 7 is domed, the height of the central lid area 7, as measured from the point where the central lid area 7 adjoins the inner peripheral rim 5 to the top of the domed central lid area 7, should not exceed the height of either the inner peripheral rim 5 or outer peripheral rim 2 if containers 14 having the lid 1 of the present invention are to be stacked one upon another. Preferably, the central lid area 7 is substantially flat in order to facilitate the stacking of containers having the lid 1 of the present invention by evenly distributing the weight of the container 14 above on the container 14 below to prevent stress cracking.

The central lid area 7 contains an opening 8. The opening 8 provides access to the contents of the container 14 on which the lid 1 is situated. The opening 8 can be situated anywhere in the central lid area 7 but is preferably located somewhere in the periphery of the central lid area 7, not centrally located, so as not to interfere with the weight distribution of the container 14 resting on top. The opening 8 can be of various shapes including, but not limited to, the following: circular, oval, square, and rectangular. Preferably the opening 8 is circular to allow the insertion of a cylindrical hose or pipe into the container to draw out the contents of the container. The opening 8 can be of various sizes.

An opening rim 9 extends around the opening 8 in the central lid area 7. The opening 8 and opening rim 9 are typically situated in a recessed portion 10 of the central lid area 7. The opening rim 9 is typically cooperatively connected to the recessed portion 10, typically the bottom portion of the recessed portion 10*b*. Alternatively, the opening rim 9 can be cooperatively connected to the top of the central lid area 7 rather than to a recessed portion 10 of the central lid area 7. The recessed portion 10 comprises a bottom portion 10*b* and a sidewall portion 10*a*. The opening 8 and opening rim 9 are situated in the bottom portion 10*b* of the recessed portion 10. The opening rim 9 can vary in height when measured from the bottom portion 10*b* of the recessed portion 10 to the top of the opening rim 9. The opening rim 9 must extend above the lowest portion of the notches 6(*a–h*) in the inner peripheral rim 5 and above the lowest portion of the notches 3(*a–h*) in the outer peripheral rim 2. If the opening rim 9 is too low, water or other liquids could enter the opening 8 and contaminate the container 14 contents. If the opening rim 9 is too high, it could interfere with the vertical stacking of containers 14 having the lid 1 of the present invention. Also, if the opening rim 9 is too high it could be damaged if the container 14 is dropped. Preferably the opening rim 9 does not extend above the inner peripheral rim 5 or outer peripheral rim 2 in order that containers 14 having lids 1 of the present invention can be securely stacked one upon another.

Preferably the opening rim 9 is circular and has threads upon which a cap can be screwed in order to protect the contents of the container 14 on which the lid 1 is situated.

Alternatively, if the opening rim 9 is unthreaded a snap on cap can be used regardless of the shape of the opening rim 9.

The recessed portion 10 in which the opening 8 and opening rim 9 are situated comprises a bottom portion 10*b* and a sidewall portion 10*a*. The recessed portion 10 can be of various shapes. The shape of the recessed portion 10 is not critical. Preferably the recessed portion 10 is of a circular shape if the lid is formed by injection molding. If the recessed portion 10 contains corners, stress cracking could result if the lid is made according to an injection molding process.

The depth of the recessed portion 10 as measured from the top of the central lid area 7 to the bottom of the recessed portion 10 can vary. If the recessed portion 10 is too deep, it could interfere with the pouring of the contents out of the container 14 when the container 14 is tilted.

The volume of the recessed portion 10 can vary. The volume must be sufficient to allow a user to get his fingers around a cap which is screwed onto the opening rim 9.

The sidewall portion 10*a* of the recessed portion 10 can extend various distances from the opening rim 9. If the sidewall portion 10*a* of the recessed portion 10 is too close to the opening rim 9, a user would not be able to screw a cap onto the opening rim 9.

The sidewall portion 10*a* and bottom portion 10*b* of the recessed portion 10 can form a recessed portion 10 having various shapes.

The sidewall portion 10*a* can adjoin the bottom portion 10*b* of the recessed portion 10 to form an angle.

In addition, the sidewall portion 10*a* and bottom portion 10*b* can form a continuous curve rather than an angle. The recessed portion 10 can also comprise numerous other shapes.

The area of the central lid area 7 that the recessed portion 10 covers and the volume of the recessed portion 10 are to some extent a function of how the lid 1 is manufactured. If the lid 1 is manufactured by an injection molding process, the area of the recessed portion 10 is limited to an extent by the constraints imposed by the production equipment. In addition, the recessed portion 10 can not be positioned directly adjacent to a notch 6*a* in the inner peripheral rim 5 and instead must be positioned a distance away from a notch 6*a* in the inner peripheral rim 5 when such a lid 1 is formed by an injection molding process.

Lids 1 formed by an injection molding process will also typically contain indentations known as stress rings 11. The stress rings 11 are typically centrally located in the central lid area 7.

The recessed portion 10 of the central lid area 7 can be positioned to intersect the stress rings 11 in order to drain water or other liquids which can accumulate in the stress rings 11.

The central lid 7 area also comprises a channel means 13. A channel means 13 can include, but is not limited to, the following: a slit, a groove, an indentation, a tube, and a tunnel.

The channel means 13 can extend from a notch 6*a* in the inner peripheral rim 5 to the sidewall portion 10*a* or bottom portion 10*b* of the recessed portion 10.

The length of the channel means 13 can vary depending on the size of the lid 1 and location of the recessed portion 10. The width and depth of the channel means 13 can vary depending upon the size of the lid 1 and the amount of water to be drained. The volume of the channel means must be adequate to relive the water which has collected in the recessed portion 10.

The channel means 13 serves to drain water or other liquids out of the recessed portion 10 by directing the water to a notch 6*a* in the inner peripheral rim 5. The recessed portion 10 itself can serve as the channel means 13. To serve as the channel means 13 itself, the recessed portion 10 is situated adjacent to a notch in the inner peripheral rim 5, thus allowing the flow of water or other liquids from the recessed portion through a notch 6*a* in the inner peripheral rim 5.

When the lid 1 of the present invention is manufactured by an injection molding process, it is oftentimes difficult to situate the recessed portion 10 directly adjacent to the inner peripheral rim 5 and, thus, it is necessary in such a case to have a channel means 13 extending from the recessed portion 10 to a notch 6*a* in the inner peripheral rim 5.

Figure 2:
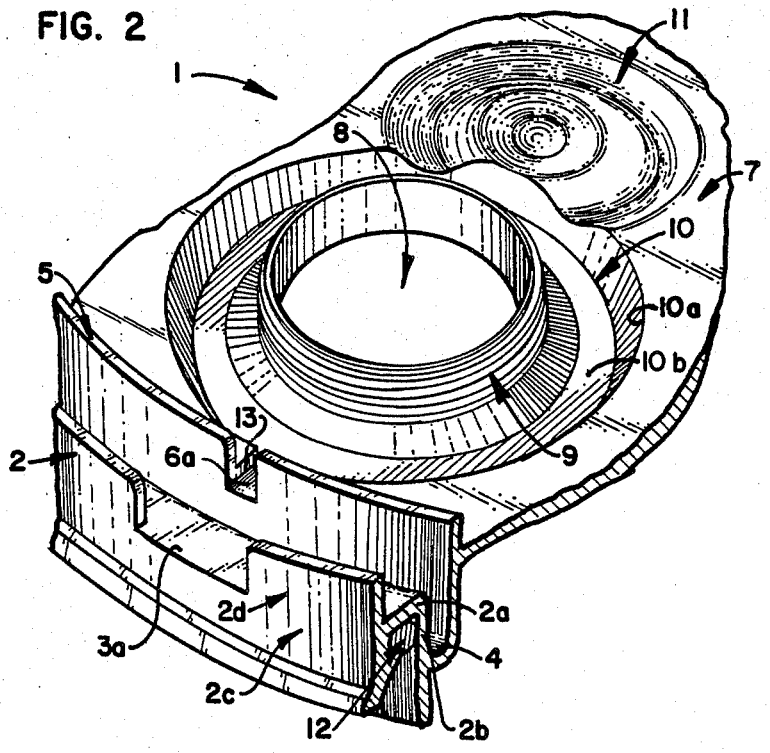
FIG. 2 is a fragmentary perspective view of the spout area of the lid shown in FIG. 1.
Figure 3:
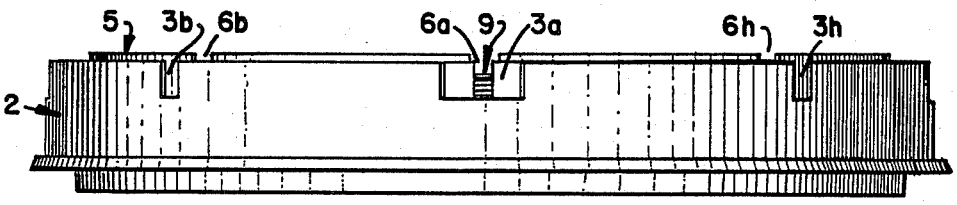
FIG. 3 is a front elevational view of the lid shown in FIG. 1.
Figure 5:
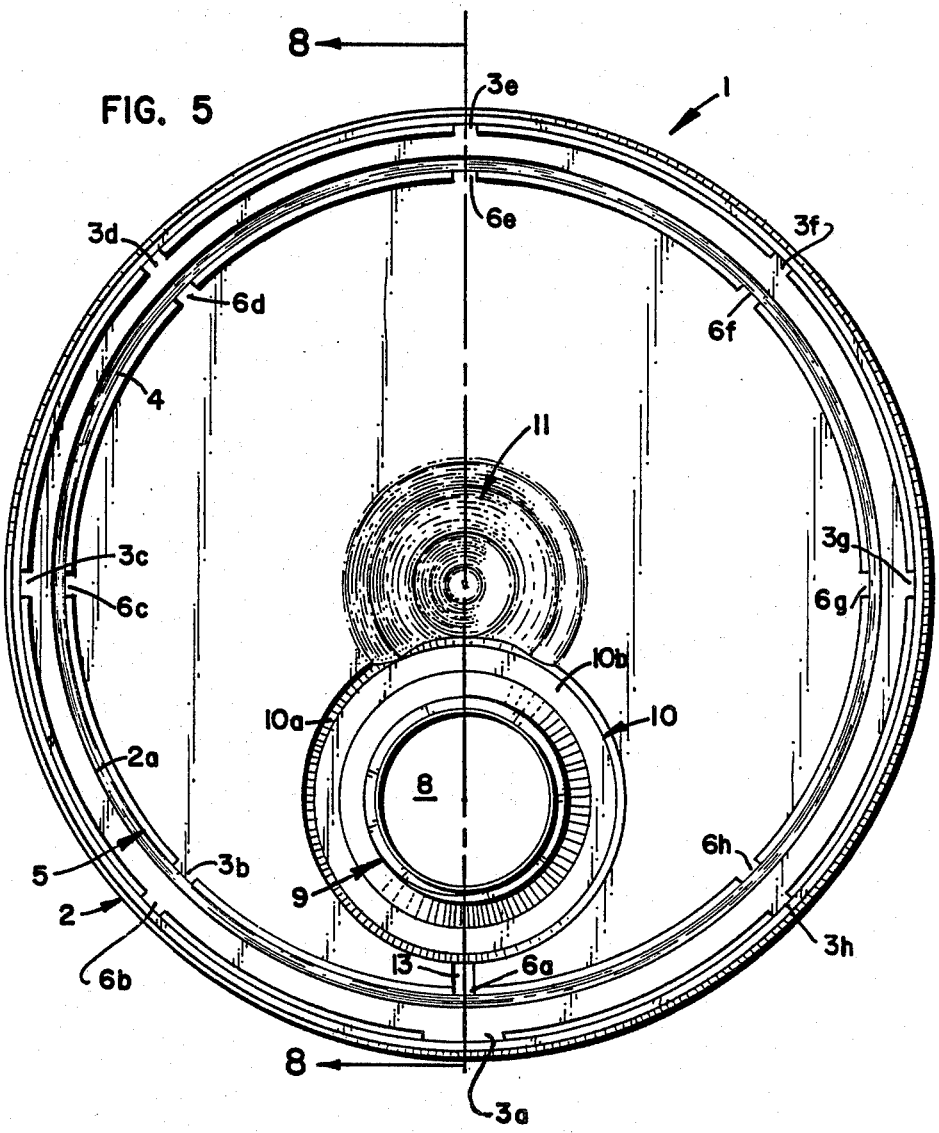
FIG. 5 is a top plan view of the lid shown in FIG. 1.
Figure 4:
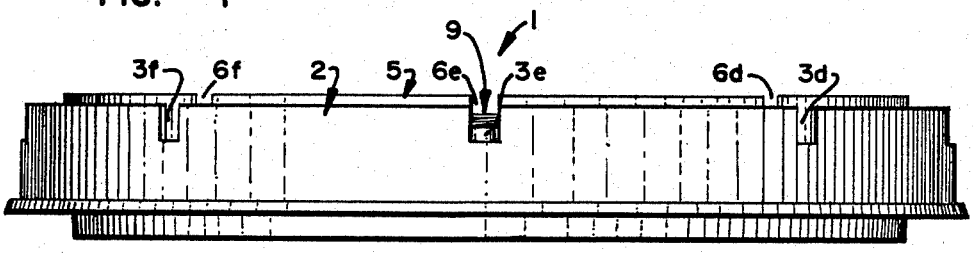
FIG. 4 is a rear elevational view of the lid shown in FIG. 1.
Figure 6:
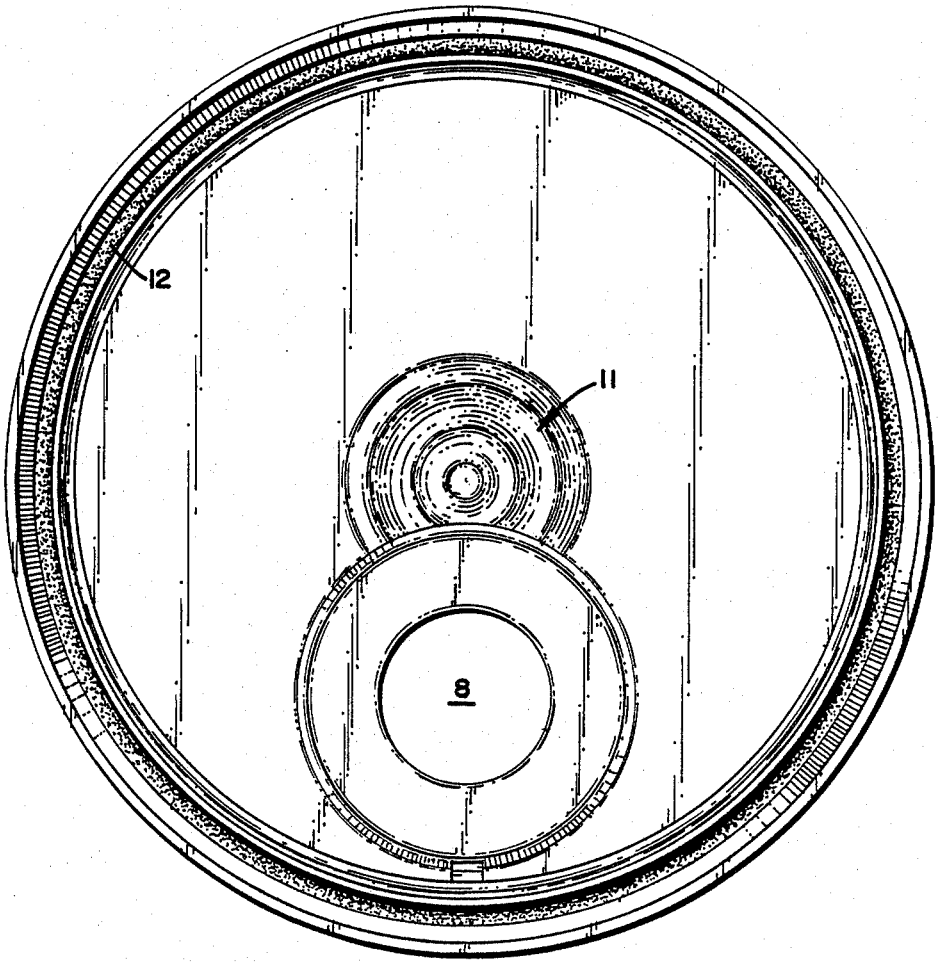
FIG. 6 is a bottom plan view of the lid shown in FIG. 1.
Figure 7:
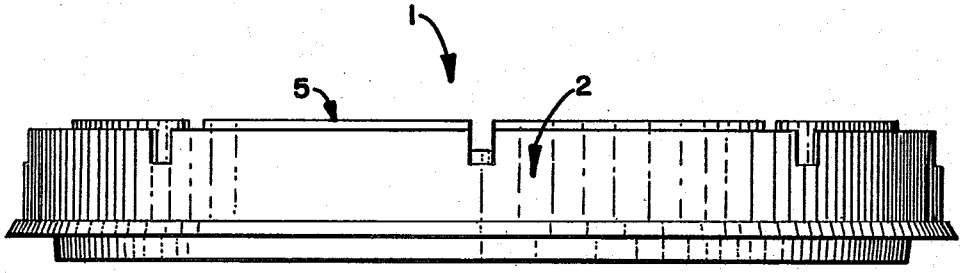
FIG. 7 is a left side elevational view of the lid shown in FIG. 1; the side opposite that shown being a mirror image.
Figure 8:
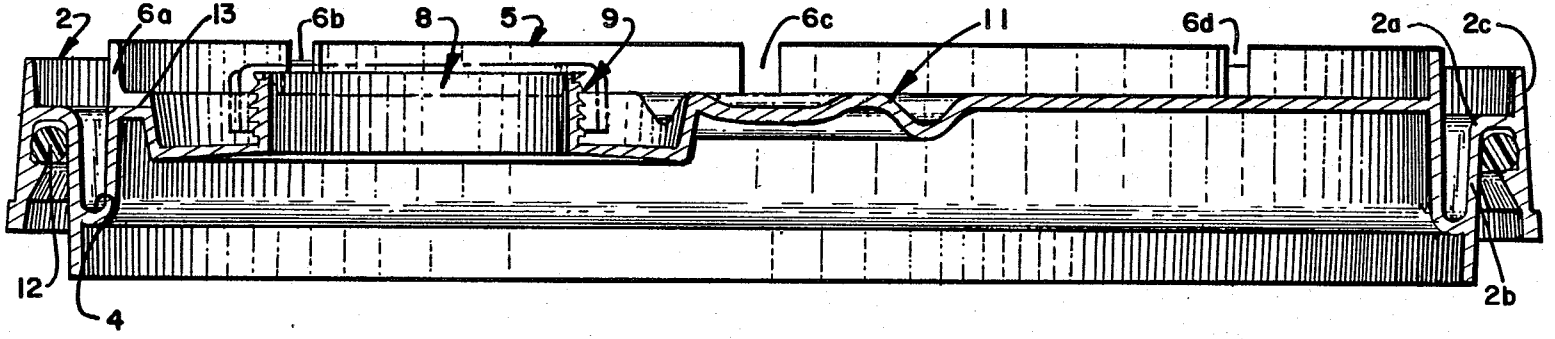
FIG. 8 is a cross sectional view taken along the line 8—8 of the lid shown in FIG. 1.
Figure 9:
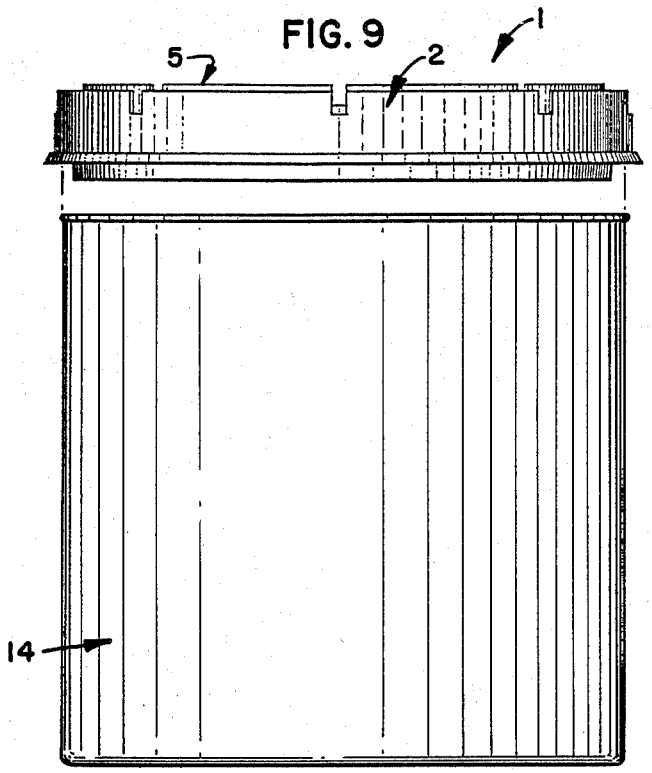
FIG. 9 is an exploded left side elevational view of the lid shown in FIG. 1 and a container upon which the lid fits.

Referring to FIGS. 1–9, the diameter of the recessed portion 10 is 4.230 inches.

The width of notches 6(*b–h*) is $\frac{1}{4}$ inch.

The width of notch 6*a* is 3/16 inch.

The width of notches 3(*b–h*) is $\frac{1}{4}$ inch.

The width of notch 3*a* is 1 inch.

The height of the inner peripheral rim 5 as measured from the central lid 7 area to the top of the inner peripheral rim 5 is 0.382 inches.

The height of the outer peripheral rim 2 as measured from ledge 2*a* to the top of the outer peripheral rim is 0.507 inches.

The notches 6(*a–h*) in the inner peripheral rim 5*a* in FIGS. 1–9 extend down to the level of the central lid area 7.

The notches 3(*a–h*) in the outer peripheral rim 2 extend down to the level of the ledge 2*a*.

The total height of the outer peripheral rim as measured from the top of the border portion 2*a* to the bottom of the outer vertical side 2*c* is 1.547 inches.

The height from the bottom of the outer 2*c* vertical side to the top of the ledge 2*a* is 1.040 inches.

The height of the opening rim 9 is 0.615 inches.

The depth of the recessed portion 10 as measured from the central lid area 7 to the bottom of the recessed portion 10 is 0.490 inches.

The distance between the border portion 2*d* of the outer peripheral rim 2 and the inner peripheral rim 5 is 9/16 inch.

The diameter of the opening 8 is $2\frac{5}{8}$ inches.

The channel means 13 has a depth of 0.122 inches, a width of 0.258 inches, and a length of 0.383 inches.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follows in the spirit and broad scope of the appended claims are included.

We claim:

1. A lid comprising:

(a) an outer peripheral rim, said outer peripheral rim having a plurality of notches;

(b) an inner peripheral rim, said inner peripheral rim lying within said outer peripheral rim, said inner peripheral rim having a plurality of notches, said notches having a bottom portion, said inner peripheral rim cooperatively connected to said outer peripheral rim; and (c) a central lid area, said central lid area lying within said inner peripheral rim, said central lid area having an opening, said opening having an opening rim, said central lid area cooperatively connected to said inner rim, and said opening rim having a height higher than the bottom portion of said notches of said inner peripheral rim.

2. The lid of claim 1, wherein said opening rim does not extend above said inner and outer peripheral rims.

3. The lid of claim 1, wherein said lid is of a circular shape.

4. The lid of claim 1, wherein said central lid area is substantially flat.

5. The lid of claim 1, wherein said notches contained in said outer peripheral rim and said inner peripheral rim are of a substantially rectangular shape.

6. The lid of claim 1, wherein said outer peripheral rim and said inner peripheral rim each contain the same number of notches.

7. The lid of claim 1, wherein said notches in said outer peripheral rim are substantially radially aligned with said notches in said inner peripheral rim.

8. A container having the lid of Claim 1,

9. A lid comprising:

(a) an outer peripheral rim, said outer peripheral rim having a plurality of notches;

(b) an inner peripheral rim, said inner peripheral rim lying within said other peripheral rim, said inner peripheral rim having a plurality of notches, said notches having a bottom portion, said inner peripheral rim cooperatively connected to said outer peripheral rim;

(c) a central lid area, said central lid area lying within said inner peripheral rim, said central lid area cooperatively connected to said inner peripheral rim, said central lid area having an opening, said opening having an opening rim, said opening and said opening rim situated in a recessed portion of said central lid area, said opening rim having a height higher than the bottom portion of said notches in said inner peripheral rim, said central lid area having a channel means, said channel means leading from said recessed portion to a notch in said inner peripheral rim.

10. The lid of claim 9, wherein said opening rim does not extend above said inner and outer peripheral rims.

11. The lid of claim 9, wherein said lid is of a circular shape.

12. The lid of claim 9 wherein said central lid area is substantially flat.

13. The lid of claim 9, wherein said notches contained in said outer peripheral rim and said inner peripheral rim are of substantially rectangular shape.

14. The lid of claim 9, wherein said outer peripheral rim and said inner peripheral rim each contain the same number of notches.

15. The lid of claim 14, wherein said notches in said outer peripheral rim are substantially radially aligned with said notches in said inner peripheral rim.

16. The lid of claim 9, wherein the recessed portion is positioned adjacent to a notch in the inner peripheral rim and thus the recessed portion itself serves as the channel means.

17. A container having the lid of claim 9.

18. A circular lid comprising:

(a) a circular outer peripheral rim having a plurality of notches;

(b) a circular inner peripheral rim, said circular inner peripheral rim lying within said circular outer peripheral rim, said circular inner peripheral rim having a plurality of notches, said notches having a bottom portion, said inner peripheral rim cooperatively connected to said outer peripheral rim; and (c) a substantially flat central lid area, said substantially flat central lid area lying within said circular inner peripheral rim and said circular outer peripheral rim, said substantially flat central lid area cooperatively connected to said circular inner peripheral rim, said substantially flat central lid area having an opening, said opening having an opening rim, said opening and said opening rim situated in a recessed portion of said substantially flat central lid area, said opening rim having a height higher than the bottom portion of said notches of said inner peripheral rim, said recessed portion having a bottom portion and a sidewall portion, said substantially flat central lid area having a channel means, said channel means leading from said recessed portion to a notch in said circular inner peripheral rim.

19. The lid of claim 18, wherein said notches contained in said circular outer peripheral rim and said circular inner peripheral rim are of a substantially rectangular shape.

20. The lid of claim 18, wherein said circular outer peripheral rim and said circular inner peripheral rim each contain the same number of notches.

21. The lid of claim 18, wherein said notches in said circular outer peripheral rim substantially line up with said notches in said circular inner peripheral rim.

22. A container having the lid of claim 18.

* * * * *

UNITED STATES PATENT AND TRADEMARK OFFICE

CERTIFICATE OF CORRECTION

PATENT NO. : 4,779,754

DATED : October 25, 1988

INVENTOR(S) : Robert J. Ten Eyck et al.

It is certified that error appears in the above-identified patent and that said Letters Patent is hereby corrected as shown below:

In column 2, line 4, please delete "rim." and substitute therefore --rim,--.

In column 3, line 29, please delete "following::" and substitute therefore --following:--.

In column 4, line 3, please delete "resistance." and substitute therefore --resistance,--.

In column 4, line 5, please delete "resin." and substitute therefore --resin,--.

In column 4, line 10, please delete "Specifically." and substitute therefore --Specifically,--.

In column 11, line 17, please delete "2 5/8" and substitute therefore --2 3/8--.

In column 12, line 4, please delete "rim." and substitute therefore --rim,--.

In column 12, line 5, please delete "rim." and substitute therefore --rim,--.

In column 12, line 6, please delete "opening." and substitute therefore --opening,--.

In column 12, line 7, please delete "rim." and substitute therefore --rim,--.

Signed and Sealed this

Fourth Day of July, 1989

*Attest:*

*Attesting Officer*

DONALD J. QUIGG

*Commissioner of Patents and Trademarks*